US005948171A

United States Patent [19]

Grothaus

[11] Patent Number: 5,948,171

[45] Date of Patent: Sep. 7, 1999

[54] ELECTROHYDRAULIC TRANSDUCER FOR CLEANING THE INNER SURFACE OF PIPES

[75] Inventor: Michael G. Grothaus, Boerne, Tex.

[73] Assignee: Southwest Research Institute, San Antonio, Tex.

[21] Appl. No.: 08/859,025

[22] Filed: May 20, 1997

[51] Int. Cl.[6] ..... B08B 3/10; B08B 3/12; B08B 7/02; B08B 9/00

[52] U.S. Cl. ..... 134/1; 134/1.1; 134/8; 134/22.11; 134/22.12; 134/34; 134/166 C; 134/169 C

[58] Field of Search ..... 134/1, 1.1, 22.11, 134/8, 22.12, 34, 166 C, 169 C

[56] References Cited

U.S. PATENT DOCUMENTS

| | | | |
|---|---|---|---|
| 3,267,710 | 8/1966 | Inoue | 72/56 |
| 3,593,551 | 7/1971 | Roth et al. | 72/56 |
| 3,797,294 | 3/1974 | Roth | 72/56 |

FOREIGN PATENT DOCUMENTS

| | | | |
|---|---|---|---|
| 404410 | 4/1976 | U.S.S.R. . | |
| 777394 | 11/1980 | U.S.S.R. | F28G 7/00 |
| 1315037 | 6/1987 | U.S.S.R. | B08B 9/00 |
| 1 428 253 | 3/1976 | United Kingdom | 134/166 C |

*Primary Examiner*—Zeinab El-Arini
*Attorney, Agent, or Firm*—Baker & Botts, L.L.P.

[57] ABSTRACT

An electrohydraulic transducer (10) for generating pulsed acoustic waves within a fluid-filled pipeline and a method of cleaning a fluid-filled pipeline with acoustic waves. A housing (11) contains a ground electrode (13) and a high voltage electrode (15), which are spaced to create a spark gap. The ground electrode (13) is connected to one conductor of a coaxial cable (14). The high voltage electrode (15) is connected to another conductor of the coaxial cable (14). Electrical pulses applied to the high voltage electrode (15) result in pulsed acoustic waves. The housing has slots (11*a*), which permit the acoustic waves to emanate radially from the transducer (10).

10 Claims, 2 Drawing Sheets

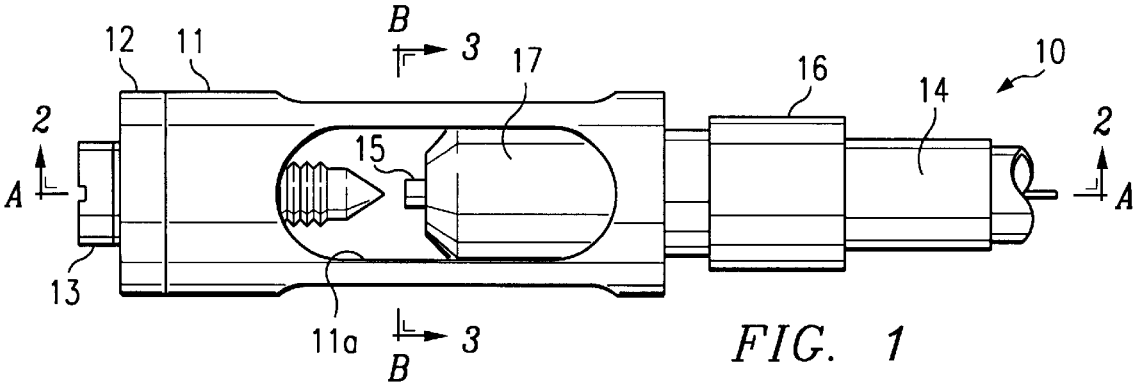
FIG. 1
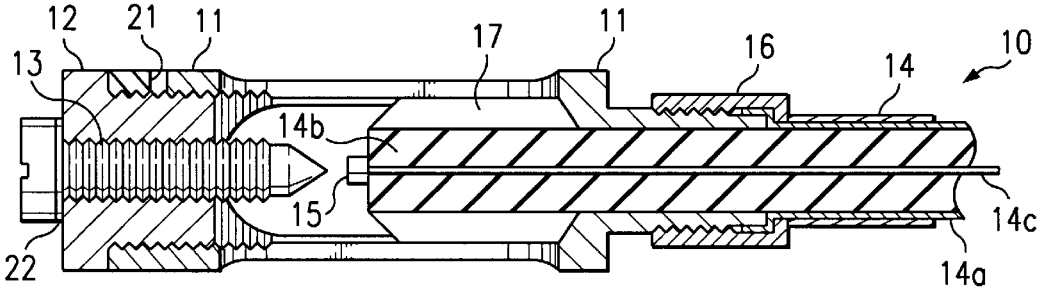
FIG. 2
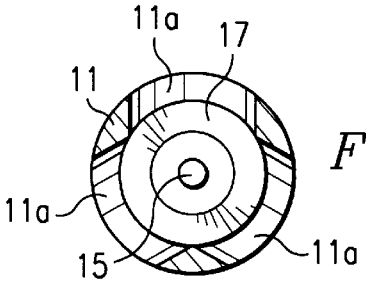
FIG. 3
FIG. 5
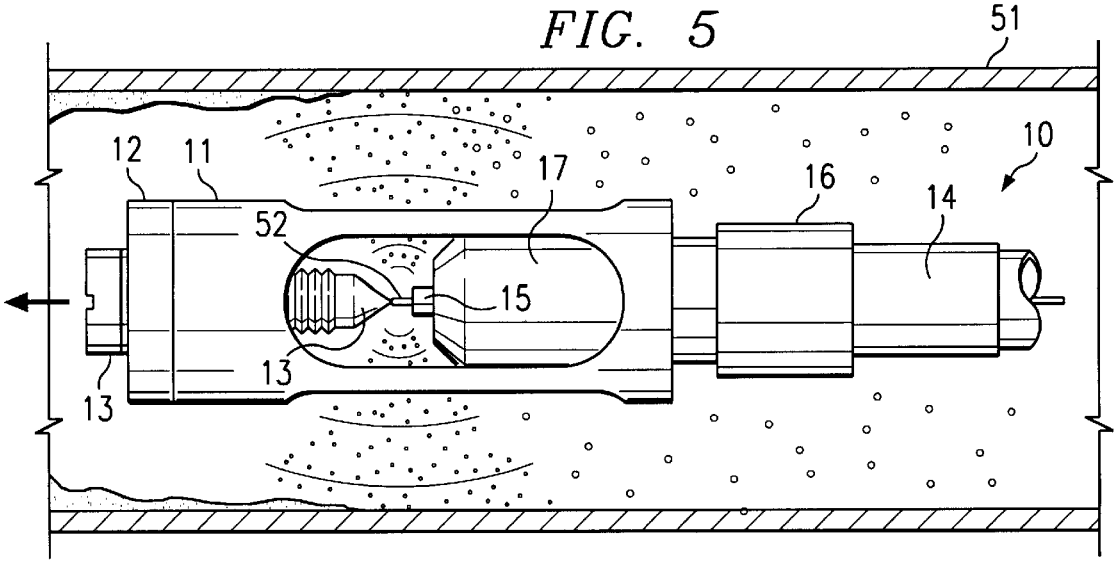

ELECTROHYDRAULIC TRANSDUCER FOR CLEANING THE INNER SURFACE OF PIPES

TECHNICAL FIELD OF THE INVENTION

The present invention relates generally to cleaning the inner surface of pipelines by means of a transducer that is placed within a pipeline and operates electrohydraulically to generate pulsed acoustic waves.

BACKGROUND OF THE INVENTION

To prevent accumulation of material on the inner walls of pipelines, various cleaning methods have been developed. One conventional method uses mechanical scrapers, which are propelled down the length of pipe via compressed air. Alternative approaches use a variety of pressurized propellants, such as water, plastic, steel grit, ice, soda, or carbon dioxide, to scrub the inner surfaces.

In recent years, increasing efforts have been made to use pipe cleaning methods that minimize adverse environmental effects. For example, governmental regulations prevent the use of chemicals that have undesired environmental impact.

Several Russian patents teach the cleaning of pipelines with electrohydraulic transducers. The transducer is placed within a fluid-filed pipeline and energized to produce acoustic waves, which agitate the fluid and the material accumulated on the inner walls of the pipeline. These Russian patents are: SU 1315037, entitled "Pipes Inner Surface Cleaning—By Forming Equal Impact Wave Simultaneously on Pipe Opposite Sides", SU 777394, entitled "Hydraulic Pipeline Inner Surface Cleaning—Using High Voltage Transformer Connected to Impeller", and SU 404410, entitled "Boiler Pipe Cleaning—Using Hydraulic Effect.

SUMMARY OF THE INVENTION

One aspect of the invention is an electrohydraulic transducer for generating acoustic waves in a fluid-filled pipeline. A transducer housing has the general shape of a hollow cylinder and has a least one slot for permitting the acoustic waves to radially emanate from the housing. A ground electrode extends axially within the housing from one end of the housing and is electrically connected to the housing. A coaxial cable is attached to the other end of the housing. The coaxial cable has an outer conductive layer electrically connected to the housing and therefore to the ground electrode. The coaxial cable also has a center conductor and an insulating layer between the outer conductor layer and the center conductor, which extend axially within the housing. A high voltage electrode is attached to the terminating end of the center conductor and is spaced opposite the ground electrode to form a spark gap within the housing adjacent to the slots. An electrically insulating spacer centers the center conductor in the housing and prevents arcing from the center conductor to the housing.

An advantage of the invention is that the acoustic energy is directed radially outward toward the pipe walls, rather than longitudinally down the length of the pipe. As a result, less energy is needed for a given cleaning effect.

Another advantage is that the electrode geometry is coaxial. This reduces system inductance, thereby enhancing the strength of the acoustic waves. The coaxial electrode geometry also provides grounding of the transducer to improve operator safety, as well as reduces electromagnetic interference with surrounding equipment.

Finally, the transducer has an extended lifetime as compared to other electrohydraulic transducers. In other transducers, unintended arcing between the electrode and other parts of the transducer across insulating surfaces tends to deteriorate the transducer. However, in the present invention, the coaxial electrode geometry and the spacer between the coaxial cable and the housing prevents such arcing.

BRIEF DESCRIPTION OF THE DRAWINGS

FIG. 1 is a side view of an electrohydraulic transducer in accordance with the invention.

FIG. 2 is a cross sectional view along the A—A axis of FIG. 1.

FIG. 3 is a cross sectional view along the B—B axis of FIG. 2.

FIG. 5 illustrates the operation of the transducer of FIG. 1 when placed in a pipeline.

DETAILED DESCRIPTION OF THE INVENTION

Figure 4:
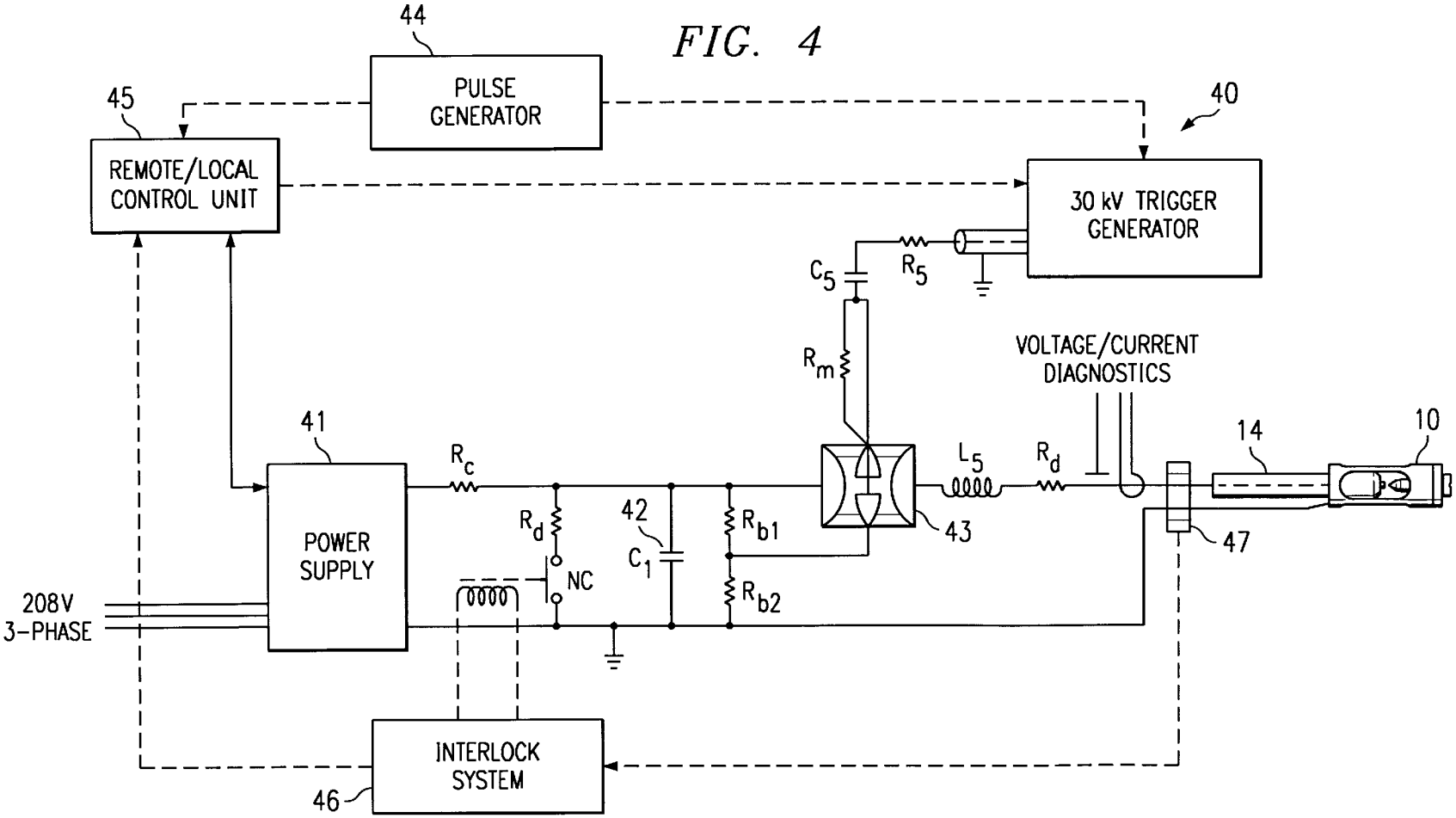
FIG. 4 illustrates a pulse generator for powering the transducer of FIG. 1.

FIGS. 1–3 illustrate an electrohydraulic transducer 10 in accordance with the invention. FIG. 1 is a side view. FIGS. 2 and 3 are cross sectional views along the axes A—A and B—B of FIG. 1, respectively. As explained below, transducer 10 is an electrohydraulic device that generates pulsed acoustic waves and directs the waves radially outward toward the pipe wall.

A housing 11 has the general shape of a hollow cylinder. Housing 11 is made from an electrically conductive material. An example of a suitable material for housing 11 is brass. As explained below, slots 11*a* in housing 11 permit shock waves generated within housing 11 to emanate radially from transducer 10.

Housing 11 contains two electrodes, a ground electrode 13 and a high voltage electrode 15. Electrodes 13 and 15 extend axially toward the center of housing 11 from opposing ends of housing 11. Electrodes 13 and 15 are in electrical connection with different conductors of a coaxial cable 14, which connects transducer to a pulse generator (described below in connection with FIG. 5). Examples of suitable coaxial cables are those known as RG-213 or RG-8.

The dimensions of transducer 10 are primarily determined by the dimensions of housing 11. The diameter of housing 11 need not be substantially larger than the coaxial cable 14 for the range of charge voltages described below in connection with FIG. 4. Its length may be sufficiently short so as to permit transducer 10 to operate in curved pipe sections. As an example, a transducer 10 for cleaning pipes one inch in diameter might have a diameter of ⅜ to ⅝ inches and a length of 1 ½ to 2 inches.

Ground electrode 13 is in electrical connection with housing 11. The attachment of ground electrode 13 to housing 11 may be accomplished with an end cap 12, which screws onto one end of housing 11. The ground electrode 13 screws into end cap 12. End cap 12 and ground electrode 13 may be held in place by any suitable means, such as by the set screw 21 and lock washer 22 shown in FIG. 2.

Housing 11 is in electrical connection with an outer conductor 14*a* of cable 14, such as a braided copper layer. Outer conductor 14*a* is compressed onto housing 11 by means of a collar nut 16. This ensures good electrical connection between outer conductor 14*a* and housing 11, and therefore grounding of housing 11 along the outer conductor 14*a*.

The insulator layer 14*b* and the center conductor 14*c* of cable 14 extend through an axial opening in the rear of housing 11 by a distance sufficient to prevent flashover or sparking along the insulator surface from the center conductor 14*c* to the housing 11. The center conductor 14*c* is terminated by a high voltage electrode 15.

High voltage electrode 15 and its axially opposing ground electrode 13 define a spark gap, which is used to generate intense underwater shock waves. Electrodes 13 and 15 are designed to be easily replaceable. As stated above, ground electrode screws into housing 11. High voltage electrode 15 is a "button" type electrode attached to center conductor 14*c* of cable 14. A suitable material for electrodes 13 and 15 is Elknoite, a copper-tungsten alloy, which has good resistance to any erosion caused by the plasma channel that is created in the spark gap during operation of transducer 10.

The spark gap spacing may be adjusted by placing additional washers 22 between the ground electrode 13 and end cap 12. This permits adjustment of the breakdown voltage and the shock wave energy.

A dielectric mismatch exists between the insulator layer 14*b* of cable 14 and the liquid within which transducer 10 operates. Because of this mismatch and the coaxial geometry, the equipotential lines concentrate in the insulator layer 14*b*, causing an intensification of the electric field strength near the interface of the insulator layer 14*b* and the center conductor 14*c* of cable 14. To grade the electric fields occurring along the surface of insulator 14*b* near high voltage electrode 15, an electrically insulating spacer 17 surrounds the portions of cable 14 that extend into housing 11. Spacer 17 ensures that the spark channel forms in the spark gap rather than from electrode 15 to housing 11. Specifically, spacer 17 prevents arcing along insulator layer 14*b* to housing 11., which would tend to cause deterioration of insulator layer 14*b* . A slant on the front surface of spacer 17 increases the length of the breakdown path between electrode 15 and housing 11 along this surface.

FIG. 4 illustrates a pulse generator 40 for providing the electrical drive signal to transducer 10. A high-voltage capacitor-charging power supply 41 delivers energy to a storage capacitor 42. Capacitor 42 discharges into coaxial cable 14 via a triggered or self-breaking spark gap switch 43. The characteristics of the applied pulse (risetime, amplitude, and damping) are primarily controlled by the inductance of cable 14, $L_s$, the storage capacitance, $C_1$, and the series limiting resistance, $R_d$. The cable 14 is charged to a voltage that exceeds the breakdown voltage of the fluid in the spark gap between electrodes 13 and 15 of transducer 10.

The repetition rate of the applied pulses is varied by a pulse generator 44, and the charge-discharge synchronization is controlled with a locally or remotely operable control unit 45. A series of safety interlocks 46 as well as a ground fault interrupt (GFI) 47 promote operator safety. The GFI 47 is triggered by any ground path other than that provided by the outer conductor 14*a* of cable 14.

Because the electrode geometry is coaxial, system inductance is reduced, which permits energy initially stored in cable 14 to be dumped quickly into the fluid between electrodes 13 and 15 to establish a plasma channel. This energy flow followed by the main current from the pulse generator 40 results in a fast pulse risetime and enhances the magnitude and effectiveness of the pulsed acoustic waves.

The operating parameters for pulse generator 40 vary depending on the specific application. Typical operating parameters for the system are:

| | |
|---|---|
| charge voltage | 15–25 kV |
| peak current | 1–10 kA |
| pulse frequency | 1–25 Hz |
| coaxial cable length | 100–200 ft |
| storage capacitance | 0.2–0.1 $\mu$F |
| total energy | 15–300 J |
| pulse risetime | 0.5–2 $\mu$s |

Cleaning effectiveness may be adjusted by adjusting the spark gap between electrodes 13 and 15 and by varying the pulse parameters.

FIG. 5 illustrates the operation of transducer, when moving along a fluid-filled pipeline 51, whose inner surface is to be cleaned. Once the breakdown voltage of the fluid in the spark gap is surpassed, a plasma channel 52 (ionized gas) is formed between electrodes 13 and 15. The gas expands into a "bubble" thereby creating the desired acoustic wave. The wave emanates radially through the slots in housing 11. A series of shock waves produces localized cavitation near the inner surface of the pipe, which breaks loose material that has accumulated there.

Enhanced embodiments of the invention could include arrays of transducers 10 for cleaning large diameter pipes. Robotics could be used to feed the transducer 10 into the piping system. Focusing electrodes could be added to preferentially direct the shock waves in a particular direction.

Other Embodiments

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An electrohydraulic transducer for generating pulsed acoustic waves in a fluid-filled pipeline, comprising:

a housing having a substantially cylindrical outer diameter and having at least one opening for permitting said fluid to enter said housing and for permitting said fluid to radially emanate from said housing as acoustic waves;

a ground electrode extending axially within said housing from a first end of said housing, said ground electrode being in electrical connection with said housing at said first end of said housing;

a coaxial cable, said cable having a first conductor in electrical connection with said housing, a second conductor, and an insulating layer between said first conductor and said second conductor, said coaxial cable extending axially within said housing from a second end of said housing and having a terminating end within said housing;

a high voltage electrode positioned at said terminating end and being in electrical connection with said second conductor;

wherein said ground electrode and said high voltage electrode are positioned within said housing such that a spark gap exists between said ground electrode and said high voltage electrode.

2. The transducer of claim 1, further comprising a spacer surrounding said coaxial cable within said housing, said spacer being made from an electrically insulating material.

3. The transducer of claim 1, wherein said coaxial cable extends within said housing such that said second conductor and said insulating layer extend to said high voltage electrode and said first conductor terminates at said second end of said housing.

4. The transducer of claim 1, wherein said spark gap is adjustable by means of positioning said ground electrode.

5. The transducer of claim 1, wherein the diameter of said housing is slightly larger than the diameter of said coaxial cable.

6. The transducer of claim 1, wherein said ground electrode and said high voltage electrode are made from a copper-tungsten alloy.

7. The transducer of claim 1, wherein said first conductor is an outer conductive layer of said coaxial cable and said second conductor is a center conductor of said coaxial cable.

8. A method of cleaning a fluid-filled pipeline with acoustic waves, comprising the steps of:

placing a ground electrode and a high voltage electrode within a housing, said housing having a substantially cylindrical outer diameter and having at least one opening for permitting said fluid to enter said housing and for permitting said fluid to radially emanate from said housing as acoustic waves, such that said ground electrode is in electrical connection with a first conductor of a coaxial cable, and such that said high voltage electrode is in electrical connection with a second conductor of said coaxial cable, and wherein said ground electrode and said high voltage electrode are positioned within said housing such that a spark gap exists between said ground electrode and said high voltage electrode adjacent said slot;

placing said housing in said pipeline;

grounding said first conductor;

applying a pulsed voltage to said second conductor; and moving said transducer along the length of said pipeline such that acoustic waves generated in response to said pulsed voltaqe emanate radially from said housing toward the inner walls of said pipeline.

9. The method of claim 8, wherein said applying step is performed such that said voltage exceeds an electrical breakdown voltage of said fluid between said electrodes, thereby creating a plasma channel between said electrodes.

10. The method of claim 8, wherein said applying step is performed with a capacitor-charging power supply.

* * * * *